US005836561A

United States Patent [19]

Liao

[11] Patent Number: 5,836,561

[45] Date of Patent: Nov. 17, 1998

[54] ANGLE-ADJUSTABLE CYMBAL HOLDER

[75] Inventor: Tsun-Chi Liao, Taichung, Taiwan

[73] Assignee: Hwa Shin Musical Instrument Co., Ltd., Taichung, Taiwan

[21] Appl. No.: 901,414

[22] Filed: Jul. 28, 1997

[51] Int. Cl.[6] ..... E04G 3/00

[52] U.S. Cl. ..... 248/291.1; 84/421; 248/299.1; 403/87; 403/110

[58] Field of Search ..... 248/177.1, 157, 248/187.1, 291.1, 299.1, 514, 515; 84/402, 403, 421, 422.1, 422.2, 422.3; 403/87, 84, 91, 100

[56] References Cited

U.S. PATENT DOCUMENTS

| | | | |
|---|---|---|---|
| 2,594,227 | 4/1952 | Smith | 3/2 |
| 3,008,259 | 11/1961 | Zornes | 43/43.12 |
| 4,912,349 | 3/1990 | Chang | 310/50 |
| 4,987,817 | 1/1991 | Diaz | 84/421 |
| 5,062,179 | 11/1991 | Huang | 16/111 R |
| 5,739,447 | 4/1998 | Hoshino | 84/402 |
| 5,756,912 | 5/1998 | Liao | 84/421 |

*Primary Examiner*—Derek J. Berger
*Assistant Examiner*—Gwendolyn Baxter
*Attorney, Agent, or Firm*—Bacon & Thomas

[57] ABSTRACT

A cymbal holder assembly including a holder base adapted to hold a cymbal, a mounting base adapted for mounting on a cymbal stand, a screw and a wing nut fastened together to fix the holder base and the mounting base together, and a constraint device mounted around the screw and retained between the holder base and the mounting base to prohibit the holder base and the mounting base from a relative rotary motion, the constraint device being released for permitting the holder base to be turned relative to the mounting base to adjust the angular position of the cymbal on the holder base when the wing nut is loosened.

4 Claims, 8 Drawing Sheets

ANGLE-ADJUSTABLE CYMBAL HOLDER

BACKGROUND OF THE INVENTION

The present invention relates to a cymbal holder assembly adapted for mounting on a cymbal stand to hold a cymbal, and more particularly to such a cymbal holder assembly that can be conveniently adjusted to change the angular position of the cymbal.

FIG. 1 shows an angle-adjustable cymbal holder assembly mounted on a cymbal stand according to the prior art. This structure of angle-adjustable cymbal holder assembly, as shown in FIG. 2 comprises a holder base having a stepped stem raised from its periphery and adapted for holding a cymbal, and a mounting base fastened to the holder base by a screw and a wing nut and having a socket raised from its periphery and adapted for fastening to a cymbal stand. The holder base and the mounting base have a respective ratchet on the inside. When the holder base and the mounting base are fixed together, the ratchet of the holder base is meshed with the ratchet of the mounting base to prohibit the holder base and the mounting base from a relative rotary motion. The engagement between the ratchets is not suitable for fine adjustment, i.e., it does not allow the holder base to be adjusted freely to the desired angle relative to the mounting base. Another drawback of this structure of angle-adjustable cymbal holder assembly is that the ratchets of the holder base and the mounting base wear quickly with use. When the ratchets start to wear, the engagement between the holder base and the mounting base becomes unstable.

SUMMARY OF THE INVENTION

The present invention has been accomplished to provide an angle-adjustable cymbal holder assembly which eliminates the aforesaid drawbacks. It is one object of the present invention to provide an angle-adjustable cymbal holder assembly which can be conveniently adjusted to change the cymbal to the desired angular position. It is another object of the present invention to provide an angle-adjustable cymbal holder assembly which is inexpensive to manufacture and easy to install. To achieve these and other objects of the present invention, there is provided an angle-adjustable cymbal holder assembly comprised a holder base adapted to hold a cymbal, a mounting base adapted for mounting on a cymbal stand, a screw and a wing nut fastened together to fix the holder base and the mounting base together, and a constraint device mounted around the screw and retained between the holder base and the mounting base to prohibit the holder base and the mounting base from a relative rotary motion. The constraint device is released for permitting the holder base to be turned relative to the mounting base to adjust the angular position of the cymbal on the holder base when the wing nut is loosened.

DETAILED DESCRIPTION OF THE PREFERRED EMBODIMENT

Figure 1:
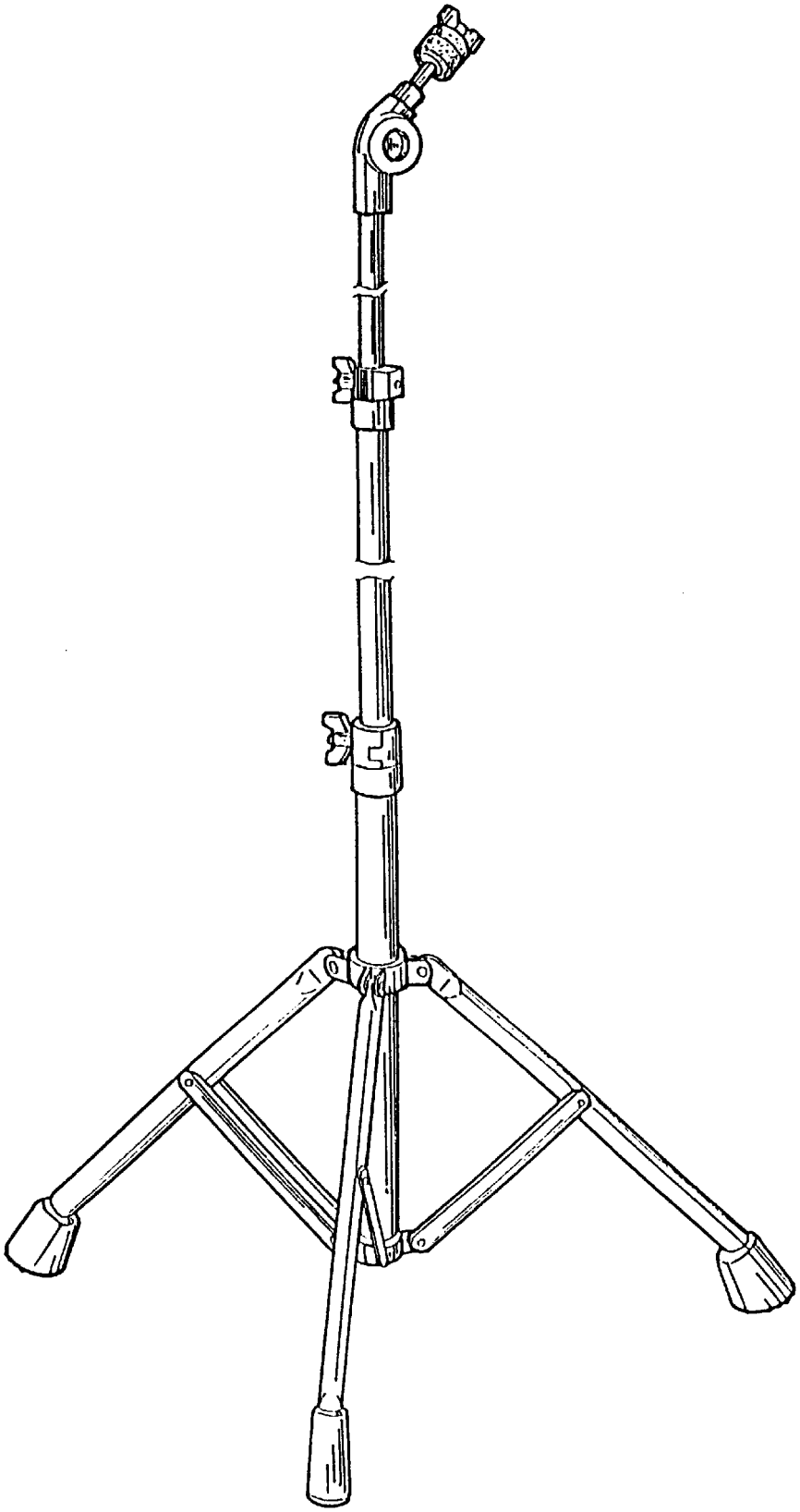
Fig. 1 PRIOR ART
FIG. 1 shows an angle-adjustable cymbal holder assembly mounted on a cymbal stand according to the prior art.
Figure 2:
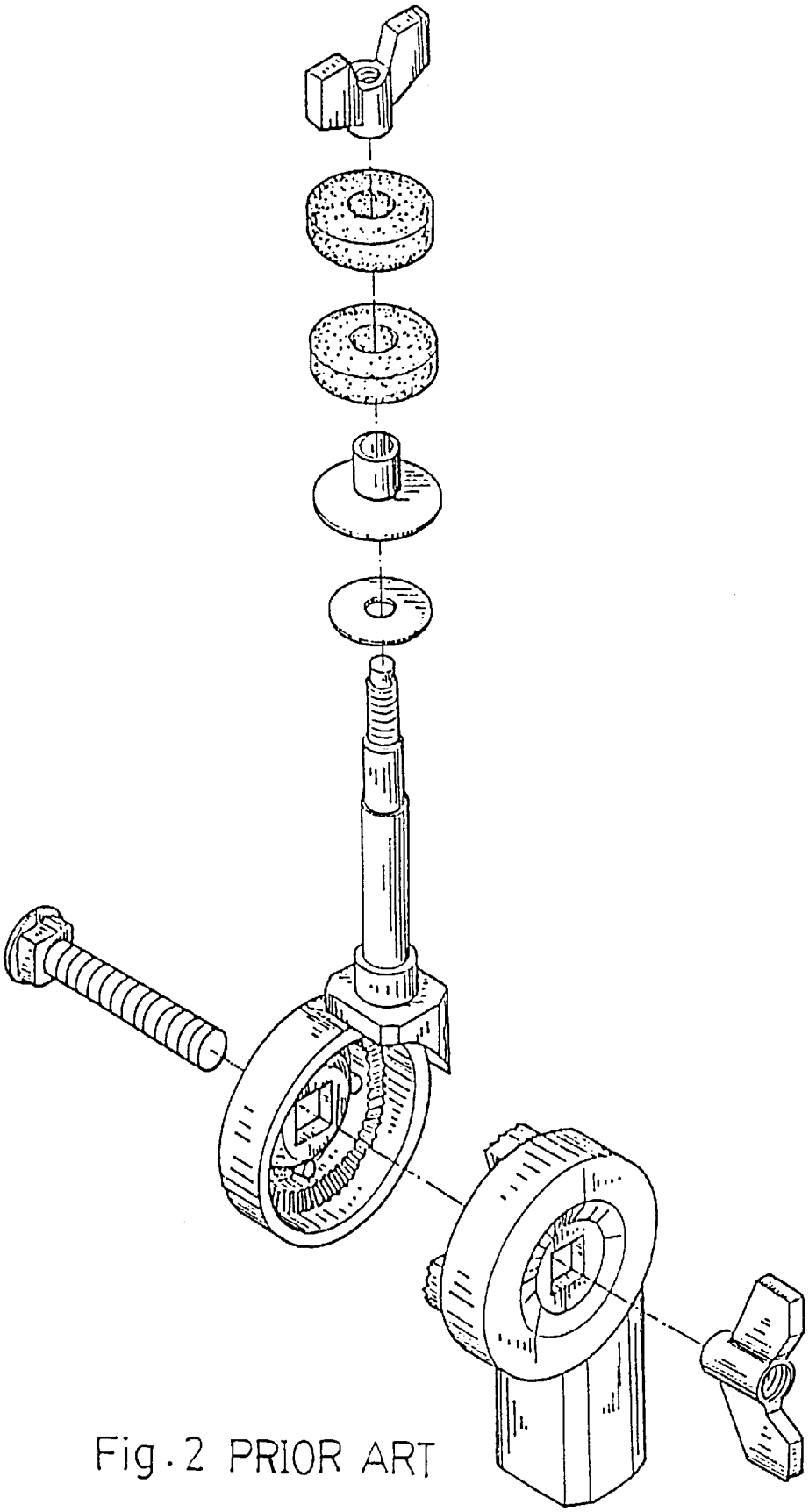
Fig. 2 PRIOR ART
FIG. 2 is an exploded view of the angle-adjustable cymbal holder assembly shown in FIG. 1.
Figure 3:
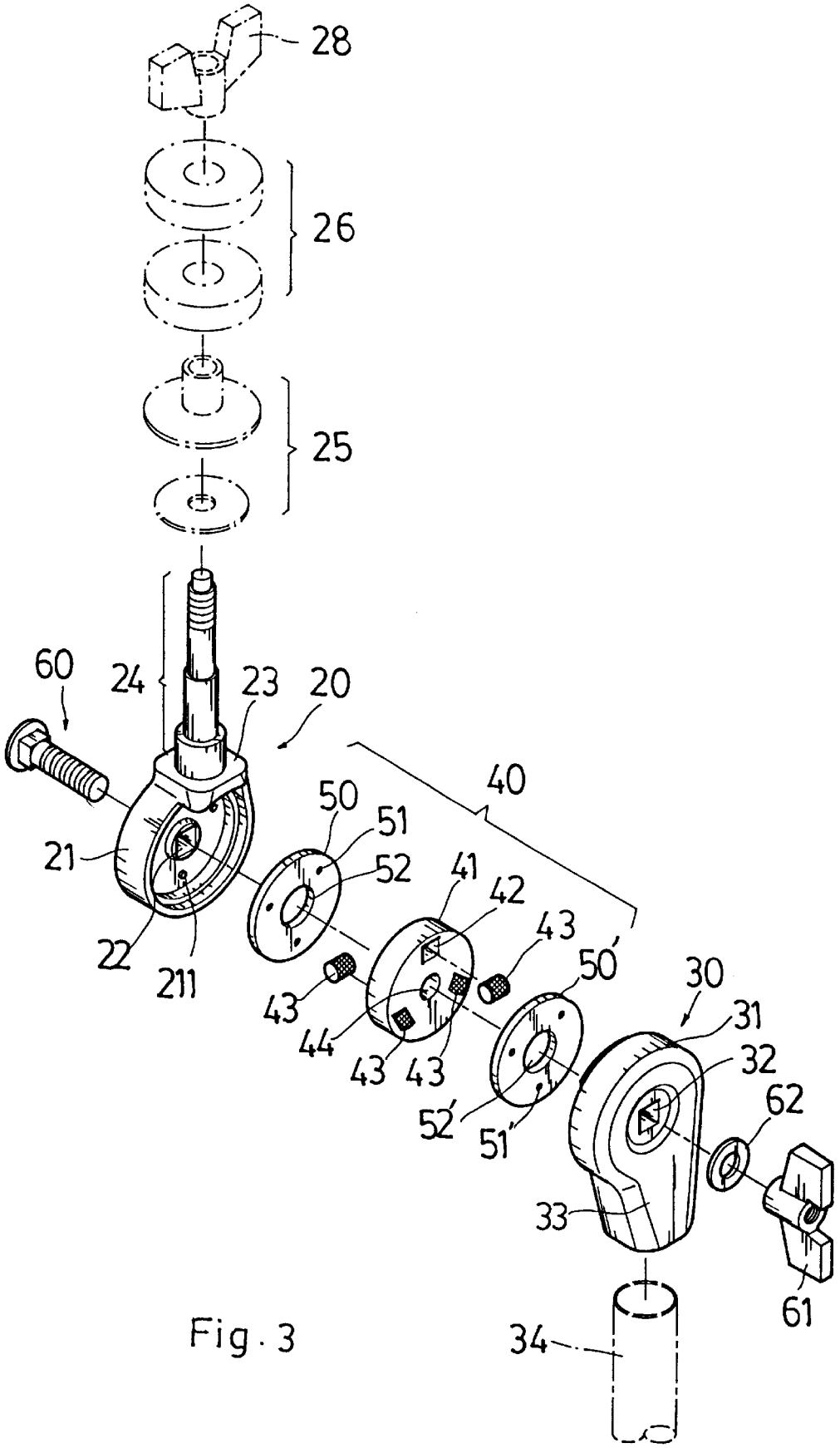
FIG. 3 is an exploded view of an angle-adjustable cymbal holder assembly according to the present invention.
Figure 4:
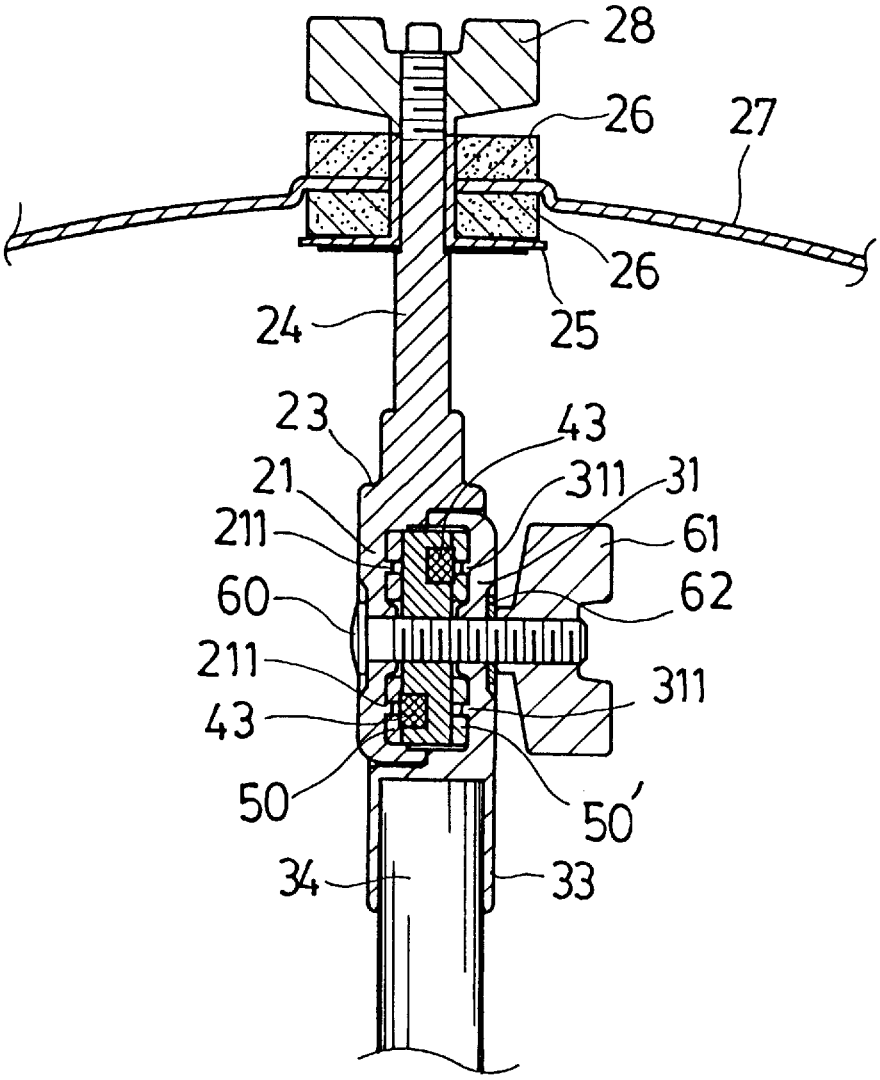
FIG. 4 is a sectional view of the present invention, showing the angle-adjustable cymbal holder assembly assembled, a cymbal fastened to the stepped stem of the holder base.

Referring to FIGS. 3, 3A, 3B and 4, an angle-adjustable cymbal holder in accordance with the present invention is generally comprised of a holder base 20, a mounting base 30 coupled to the holder base 20, and a constraint device 40 mounted between the holder base 20 and the mounting base 30.

The holder base 20 comprises a hollow circular base frame 21, a through hole 22 at the center of the circular base frame 21, a plurality of locating pins 211 axially raised from the hollow circular base frame 21 on the inside, a block 23 raised from the periphery of the hollow circular base frame 21, and a stepped stem 24 raised from the block 23. A cymbal 27 is mounted on the stepped stem 24 and retained between two cushions 26, which are mounted around the stepped stem 24 and firmly retained in place by locating elements 25 and a wing nut 28. The wing nut 28 is threaded onto the threaded top end of the stepped stem 24 to fix the cushions 26 in place, permitting the cymbal 27 to be firmly retained around the stepped stem 24 between the cushions 26.

The mounting base 30 comprises a hollow circular base frame 31, a through hole 32 at the center of the circular base frame 31, a plurality of locating pins 311 axially raised from the hollow circular base frame 31 on the inside, and a socket 33 raised from the periphery of the hollow circular base frame 31 and fastened to a shaft 34.

The constraint device 40 is mounted within the hollow circular base frame 21 of the holder base 20 and the hollow circular base frame 31 of the mounting base 30 to prohibit the holder base 20 and the mounting base 30 from a relative rotary motion, comprised of a flat zinc block 41 having a center through hole 44 and two sets of recessed holes 42 at its two opposite sides, a plurality of embossed steel friction rods 43 respectively mounted in the recessed holes 42 of the flat zinc block 41 and peripherally partially projecting out of the flat zinc block 41, a first aluminum friction plate 50 mounted within the hollow circular base frame 21 of the holder base 20 and having a plain side disposed in contact with the corresponding embossed steel friction rods 43 at one side of the flat zinc block 41 and a center through hole 52 and a plurality of pin holes 51 respectively fastened to the locating pins 211 of the hollow circular base frame 21 of the holder base 20, and a second aluminum friction plate 50' mounted within the hollow circular base frame 31 of the mounting base 30 and having a plain side disposed in contact with the corresponding embossed steel friction rods 43 at an opposite side of the flat zinc block 41 and a center through hole 52' and a plurality of pin holes 51' respectively fastened to the locating pins 311 of the hollow circular base frame 31 of the mounting base 30. A screw 60 is inserted in proper order through the center through hole 22 of the hollow circular base frame 21 of the holder base 20, the center through hole 52 of the first aluminum friction plate 50, the center through hole 44 of the flat zinc block 41, the center through hole 52' of the second aluminum friction plate 50' and the center through hole 32 of the hollow circular base frame 31 of the mounting base 30, and then screwed up with a wing nut 61 to fix the holder base 20, the constraint device 40 and the mounting base 30 together. Further, a washer 62 is mounted around the screw 60 and retained between the hollow circular base frame 31 of the mounting base 30 and the wing nut 61.

Figure 5A:
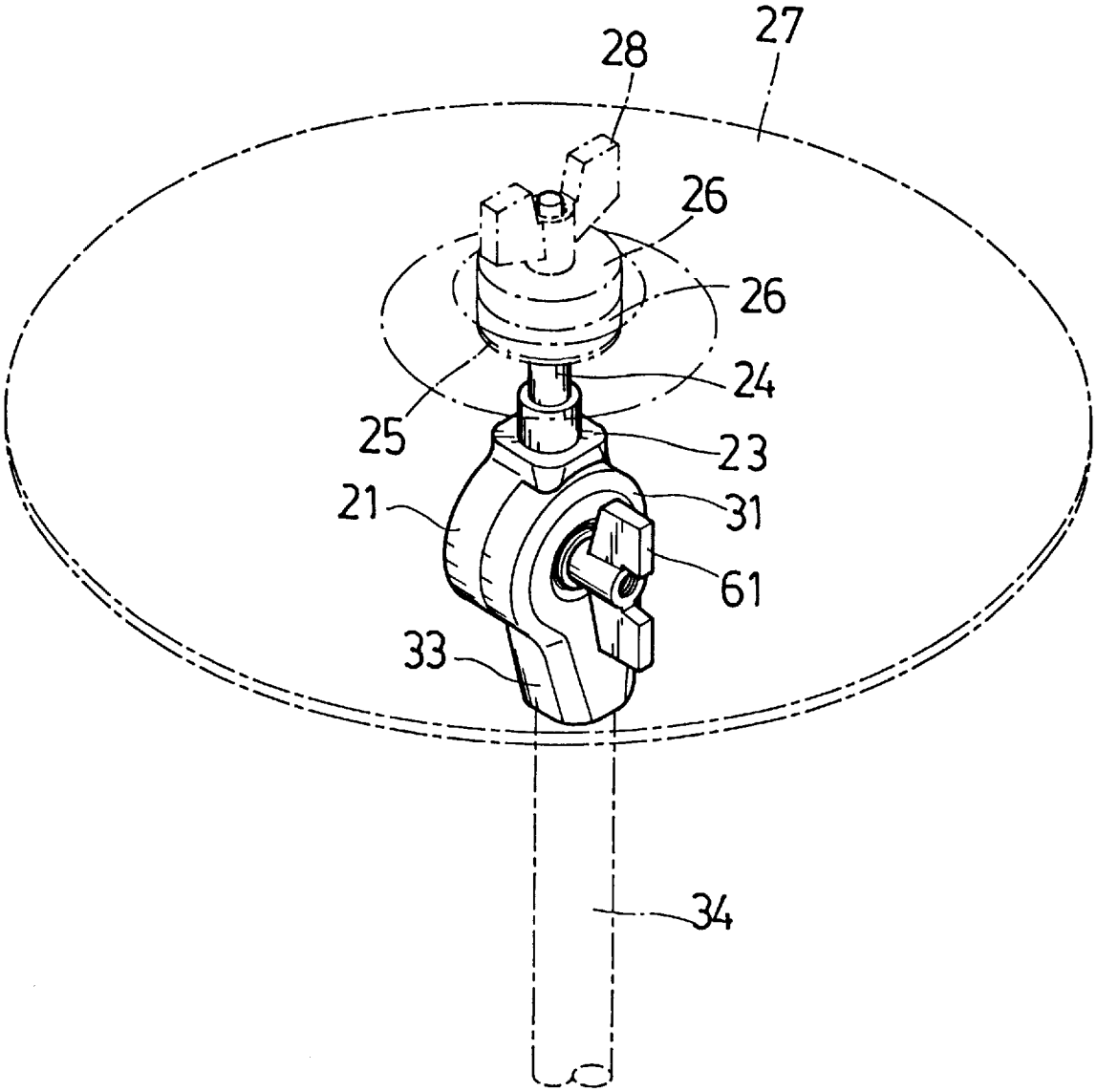
FIG. 5A is a perspective view of FIG. 4.
Figure 5B:
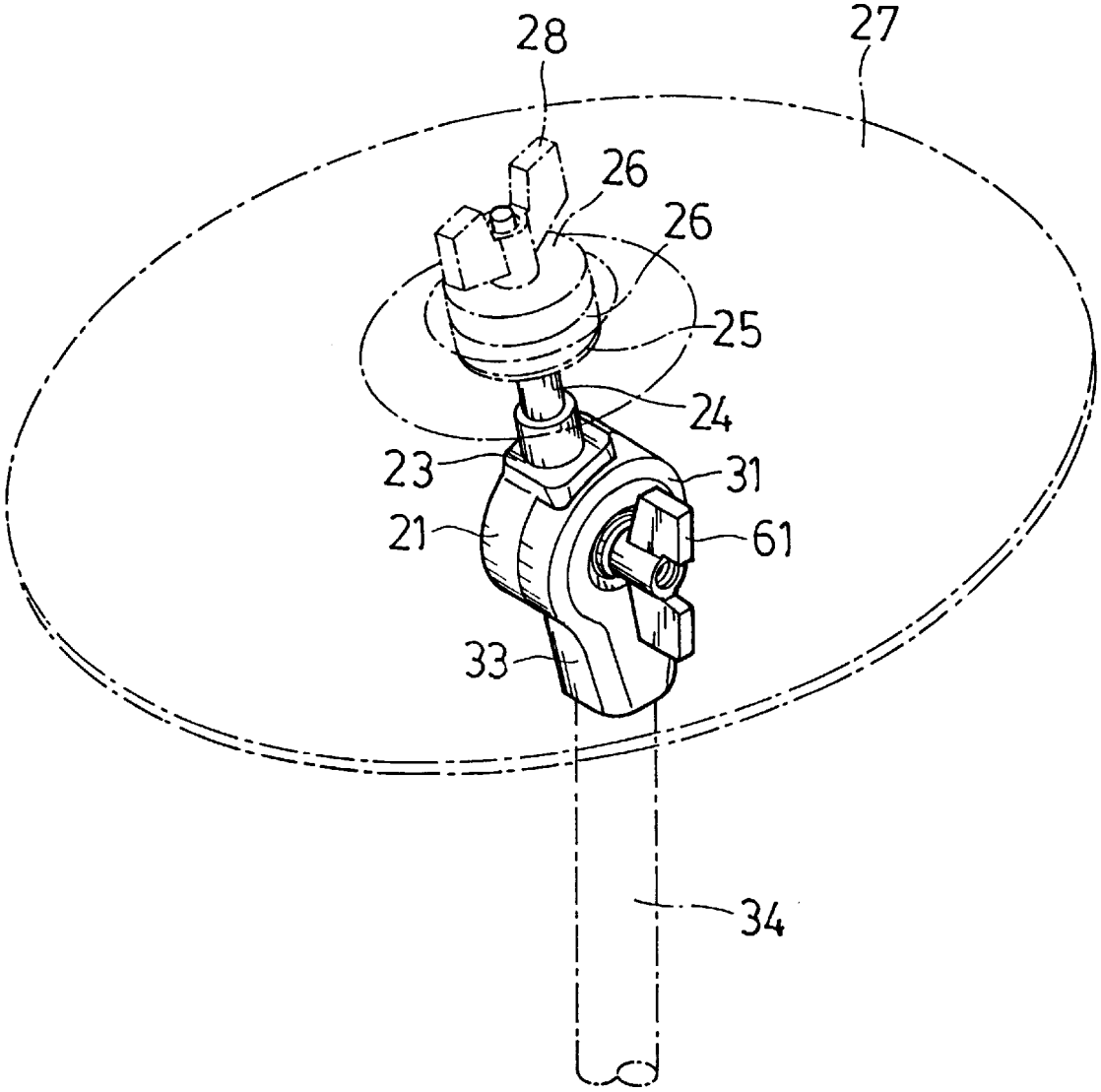
FIG. 5B is similar to FIG. 5A but showing the angular position of the cymbal adjusted.

Referring to FIGS. 5A and 5B and FIGS. 3 and 4 again, when the wing nut 61 is loosened, the aluminum friction plates 50; 50' are released from the constraint of the embossed steel friction rods 43 and can be respectively turned with the holder base 20 and the mounting base 30, therefore the holder base 20 can be turned relative to the mounting base 30 to change the angular position of the cymbal 27. When adjusted, the wing nut 61 is fastened up again to fix the holder base 20 and the constraint device 40 and the mounting base 30 together, and therefore the cymbal 27 is firmly retained in the adjusted angular position.

Figure 6:
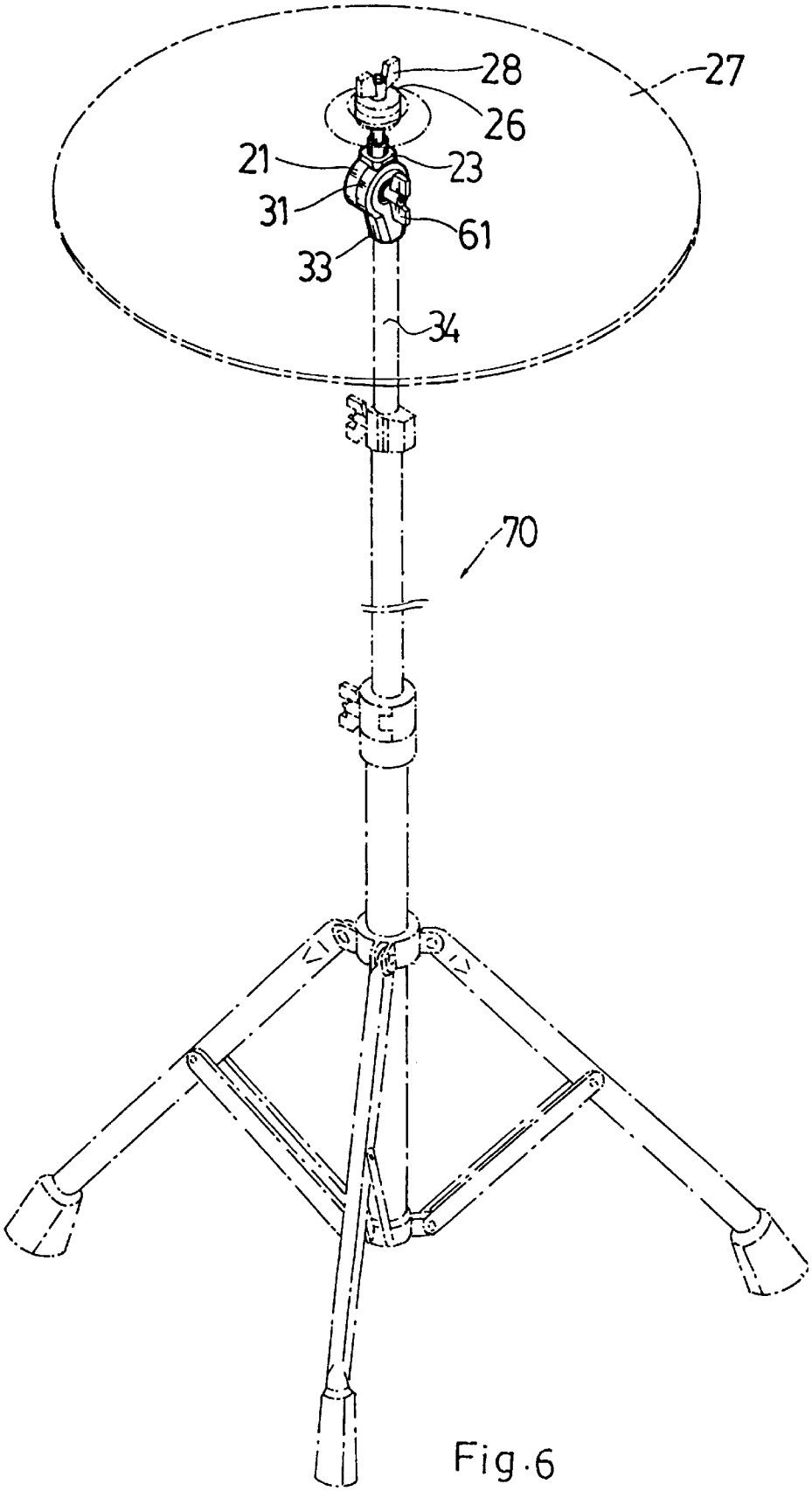
FIG. 6 shows a installation example of the present invention.

FIG. 6 shows an installation example of the present invention, in which the aforesaid shaft 34 which is connected to the socket 33 of the mounting base 30 is fastened to a cymbal stand 70.

Figure 7:
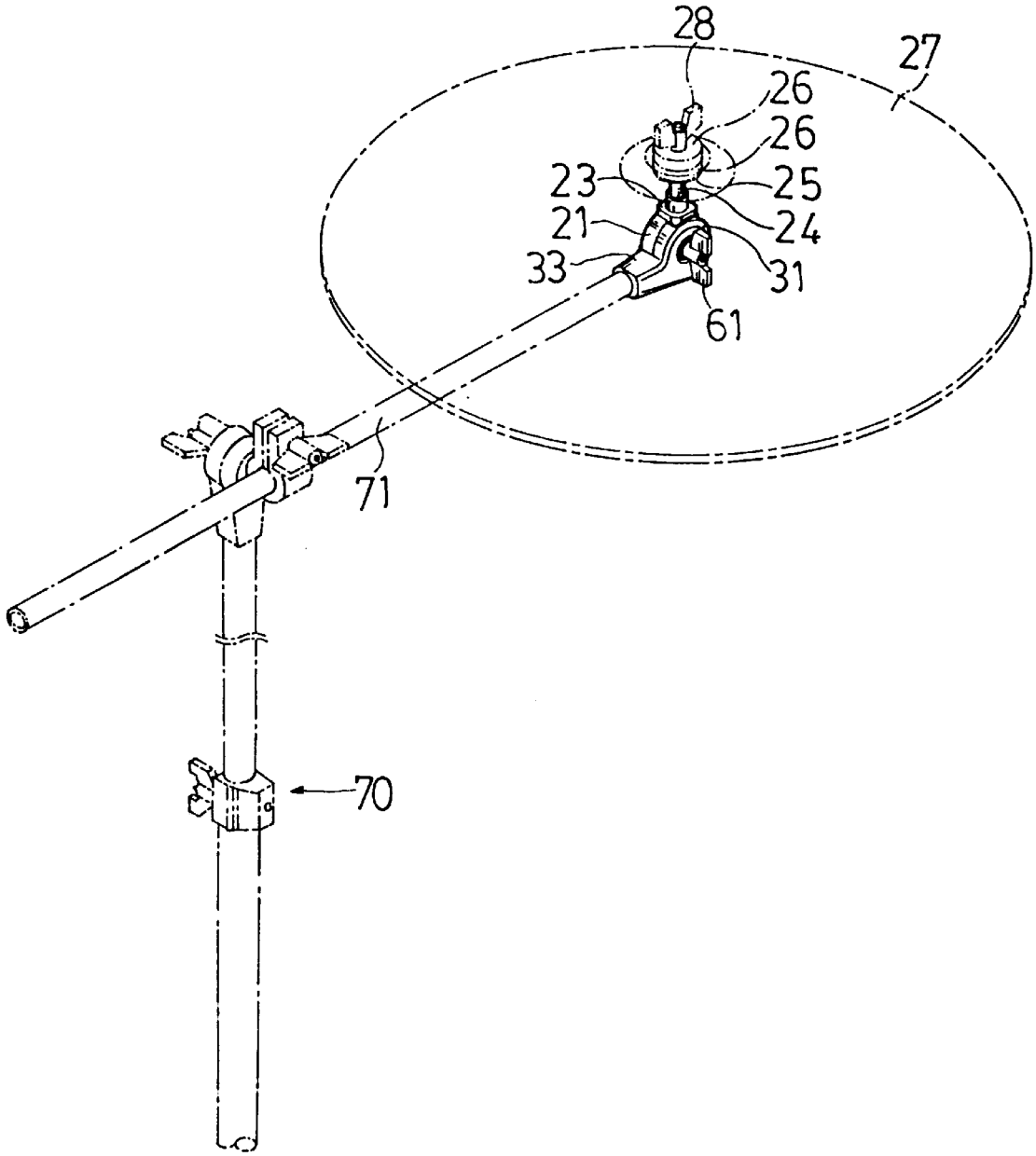
FIG. 7 shows another installation example of the present invention.

FIG. 7 shows another installation example of the present invention, in which the socket 33 of the mounting base 30 is fastened to one end of a support rod 71 of a cymbal stand 70.

While only one embodiment of the present invention has been shown and described, it will be understood that various modifications and changes could be made thereunto without departing from the spirit and scope of the invention disclosed.

We claim:

1. A cymbal holder assembly comprising a holder base adapted to hold a cymbal, a mounting base fastened to said holder base by a screw and a wing nut, and a constraint device mounted within said holder base and said mounting base and adapted to prohibit said holder base and said mounting base from a relative rotary motion, said constraint device comprising a flat friction rod holder block having a center through hole through which said screw passes and two sets of recessed holes at two opposite sides thereof, a first set of embossed friction rods and a second set of embossed friction rods respectively mounted in said recessed holes of said flat friction rod holder block, a first friction plate mounted within said holder base around said screw and prohibited from a rotary motion relative to said holder base and disposed in contact with said first set of embossed friction rods, and a second friction plate mounted within said mounting base and prohibited from a rotary motion relative to said mounting base and disposed in contact with said second set of embossed friction rods.

2. The cymbal holder assembly of claim 1, wherein said first and second sets of embossed friction rods are respectively made from rigid metal.

3. The cymbal holder assembly of claim 1, wherein said first and second friction plates are respectively made from flexible metal, having respectively a plurality of equiangularly spaced pin holes; said holder base and said mounting base have a respective set of equiangularly spaced locating pins disposed on the inside and respectively fitted into the pin holes of said first and second friction plates.

4. The cymbal holder assembly of claim 1, wherein said first and second friction plates have a respective plain surface at one side respectively disposed in contact with said embossed friction rods.

* * * * *